US009284094B2

(12) United States Patent
Khalil

(10) Patent No.: US 9,284,094 B2
(45) Date of Patent: Mar. 15, 2016

(54) COLLAPSIBLE CONTAINER

(71) Applicant: Husni Khalil, West Warwick, RI (US)

(72) Inventor: Husni Khalil, West Warwick, RI (US)

( * ) Notice: Subject to any disclaimer, the term of this patent is extended or adjusted under 35 U.S.C. 154(b) by 0 days.

(21) Appl. No.: 13/904,110

(22) Filed: May 29, 2013

(65) Prior Publication Data

US 2014/0353321 A1 Dec. 4, 2014

(51) Int. Cl.
*B65D 1/40* (2006.01)
*B65D 21/08* (2006.01)

(52) U.S. Cl.
CPC ..... *B65D 21/086* (2013.01)

(58) Field of Classification Search
CPC ..... B65D 1/40; B65D 21/086; B65D 88/52; B65D 81/2007; B65D 1/42; B65D 1/44
USPC ..... 220/666, 720, 651, 640, 6, 8, 4.28
See application file for complete search history.

(56) References Cited

U.S. PATENT DOCUMENTS

| | | | | | |
|---|---|---|---|---|---|
| 3,083,877 | A | | 4/1963 | Gash | |
| 3,347,060 | A | * | 10/1967 | Barkan | 62/457.9 |
| 3,603,367 | A | * | 9/1971 | Lehrman | 220/9.3 |
| 4,036,361 | A | * | 7/1977 | Jacobson et al. | 206/597 |
| 4,428,507 | A | | 1/1984 | Sneider | |
| 4,917,254 | A | * | 4/1990 | Ciriacks | 220/666 |
| 5,027,963 | A | * | 7/1991 | Robbins, III | 215/395 |
| 5,464,113 | A | * | 11/1995 | Ho et al. | 220/9.2 |
| 6,089,394 | A | * | 7/2000 | Ziglar | 220/6 |
| 6,202,849 | B1 | * | 3/2001 | Graham | 206/524.8 |
| 6,431,406 | B1 | * | 8/2002 | Pruett | 222/210 |
| 7,225,841 | B2 | * | 6/2007 | Folk | 141/114 |
| 7,322,286 | B2 | * | 1/2008 | Labeille et al. | 100/211 |
| D570,705 | S | | 6/2008 | Kanda | |
| 7,390,011 | B1 | * | 6/2008 | Hem | 280/638 |
| 8,146,773 | B2 | * | 4/2012 | Turvey et al. | 220/666 |
| 8,317,047 | B2 | * | 11/2012 | Vanderberg et al. | 220/6 |
| 8,453,862 | B2 | * | 6/2013 | Wang | 220/23.4 |
| 2006/0266754 | A1 | * | 11/2006 | Carmona | 220/666 |
| 2007/0023439 | A1 | * | 2/2007 | Vaughn | 220/592.03 |
| 2009/0230012 | A1 | * | 9/2009 | Choy et al. | 206/524.8 |
| 2012/0048770 | A1 | * | 3/2012 | Choy et al. | 206/524.8 |
| 2012/0267366 | A1 | * | 10/2012 | Wang | 220/7 |

* cited by examiner

*Primary Examiner* — Steven A. Reynolds
(74) *Attorney, Agent, or Firm* — Barlow, Josephs & Holmes, Ltd.

(57) ABSTRACT

The collapsible container is disclosed. The container has a body having an open top end, a sidewall having an accordion fold, and a bottom panel enclosing a bottom end. The accordion fold in the sidewall permits the sidewall to collapse and expand between a collapsed position and an expanded position. A collar is formed at a top end of the body, extending from the sidewall. A support is configured and arranged to prop the sidewall in a fully expanded position. A lid with an airlock may be included to permit the body to be vacuum sealed.

9 Claims, 2 Drawing Sheets

COLLAPSIBLE CONTAINER

BACKGROUND OF THE INVENTION

1. Field of the Invention

The present patent document relates generally to storage containers and more particularly to a collapsible container that may be collapsed when not in use and expanded when additional storage space is desired.

2. Background of the Related Art

Storage bins are useful items to collect articles in while not in use. People can rotate off-season clothing into bins to free up room in closets and dressers. Other articles can be stored safely without worry that the articles will be damaged by insects or other vermin. Furthermore, if the ultimate disposition of the articles is in questions, the articles can be kept until it is known the manner in which they will be disposed, such as given to good will, friends, or family. However, these bins take up substantial room. Therefore, there is a perceived need in the art for a storage bin that is easily stored when not in use, but has a large capacity when the need for its use arises, yet is sturdy and stackable. Furthermore, there is a perceived need for a bin that can also be compacted when not filled to capacity.

SUMMARY OF THE INVENTION

The collapsible container described herein solves the problems of the prior art by providing a container having a body having an open top end, a sidewall having an accordion fold, and a bottom panel enclosing a bottom end. The accordion fold in the sidewall permits the sidewall to collapse and expand between a collapsed position and an expanded position. A collar is formed at a top end of the body, extending from the sidewall. A support is configured and arranged to prop the sidewall in a fully expanded position, adding rigidity to the container and enabling multiple containers to be stacked atop one another. The container may be vacuum sealed, compacting the sidewall, thereby reducing the size the container when it is only partially filled.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
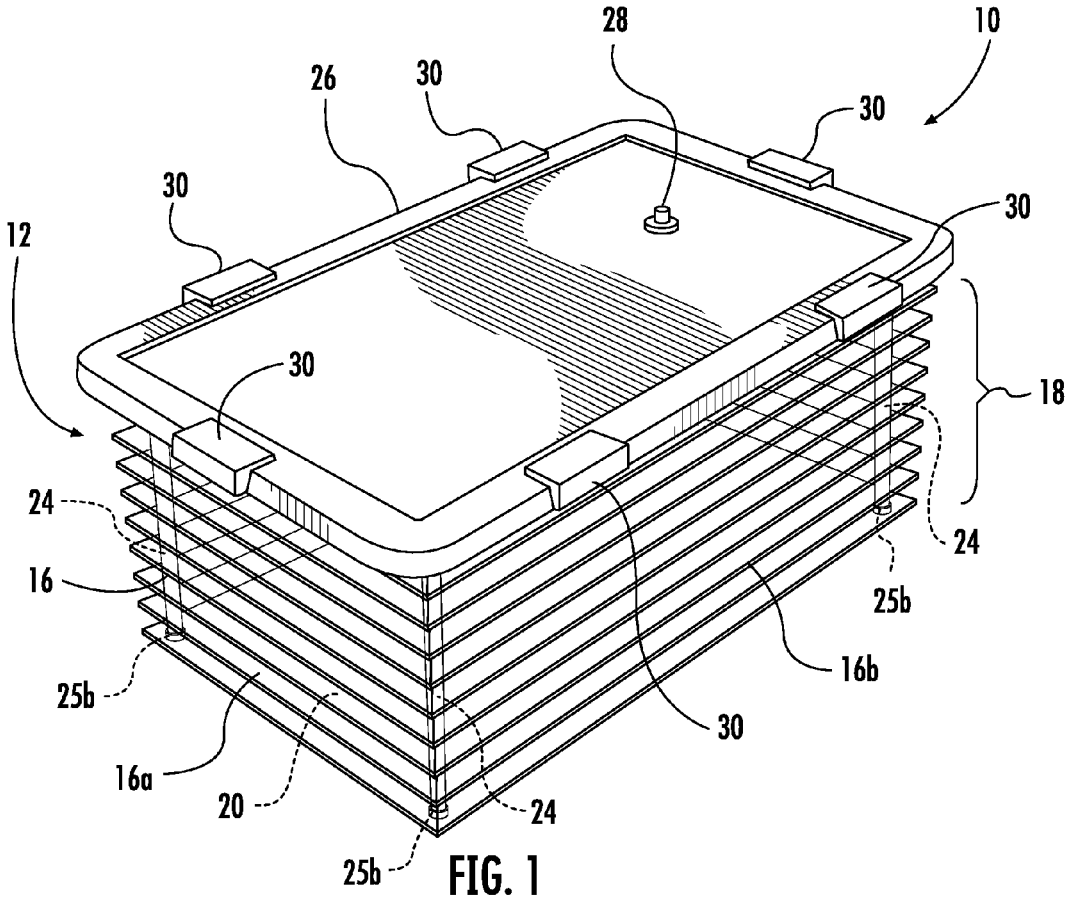
FIG. 1 is a perspective view of a collapsible container, expanded.
Figure 2:
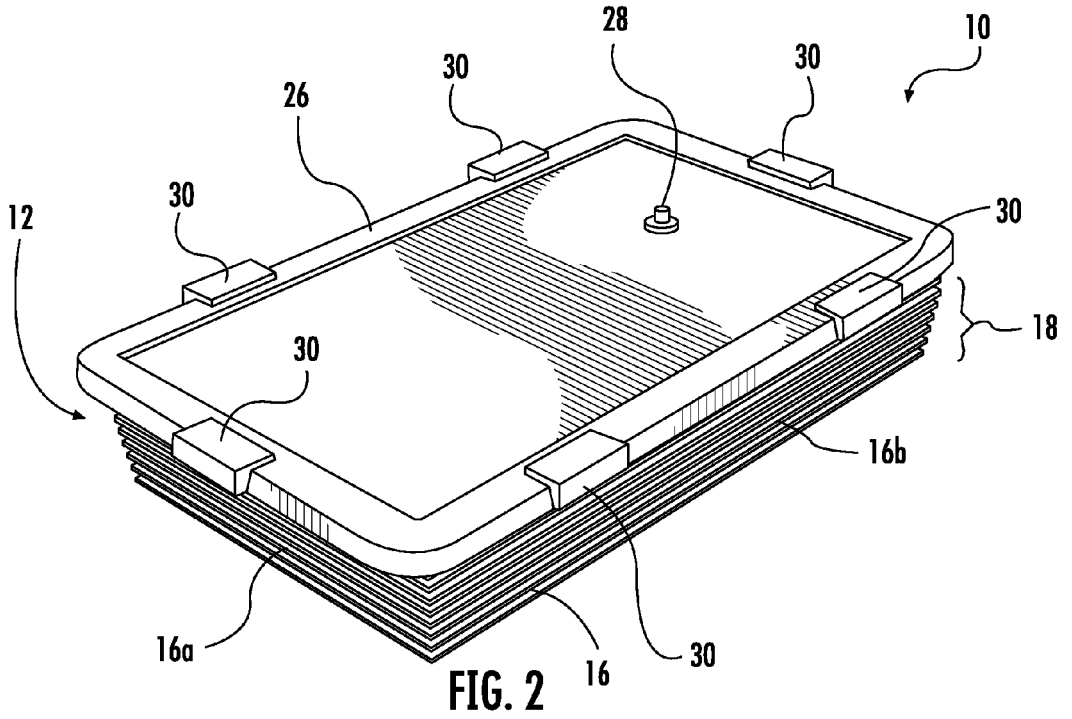
FIG. 2 is a perspective view of a collapsible container, collapsed.
Figure 3:
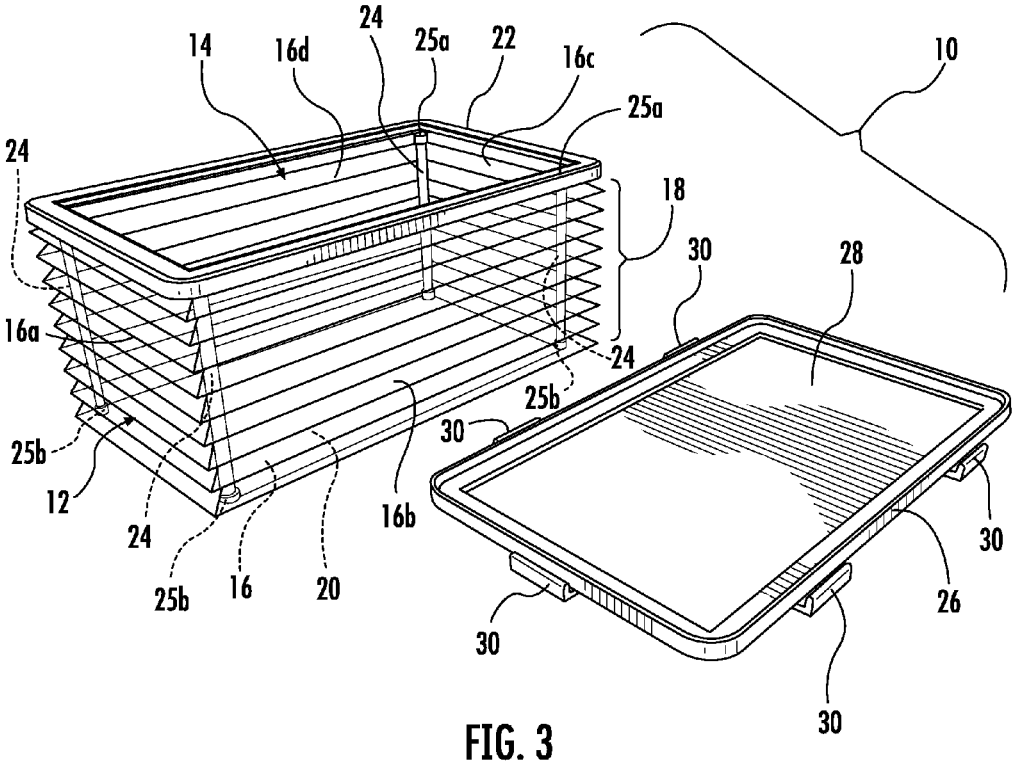
FIG. 3 is a perspective view of a collapsible container, expanded with the lid removed.

Referring now to FIGS. 1-3, the collapsible container is shown generally at 10. The container 10 includes a body 12 having an open top end 14, a continuous sidewall 16 with an accordion fold 18, and a bottom panel 20 enclosing a bottom end. A rigid collar 22 is formed at the top of the sidewall 16. The collar 22 may include a rubberized or elastomeric portion, forming a seal thereon in combination with a lid 26 described further below.

The sidewall 16 may be formed into a number of sides 16*a-d*, such as four. Although the body 12 of the container 10 is shown having a generally rectangular shape with four sides 16*a-d*, other dimensions and numbers of sides may be varied. For instance, the body 12 may be cube shaped, cylindrical, trapezoidal, or parallelogram-shaped as desired by manufacturing the lengths of the sides the desired dimensions.

At each corner formed in the sidewall 16, a support 24 is fitted between the bottom panel 20 and the collar 22, thereby adding rigidity to the container 10 and keeping it from collapsing if multiple containers 10 are stacked atop one another. The supports 24 may be tubular. Cups 25*a*, 25*b* may be formed in the collar 22 and bottom panel 20 for receiving the ends of the supports 24, thereby preventing them from becoming easily dislodged, avoiding inadvertent collapsing of the container 10. The supports 24 may be stored insides the container 10 when the sidewall 16 is collapsed, or as further described below, not installed at all in order to vacuum seal the container 10.

A lid 26 couples or snaps onto the collar 22, enclosing the open top end 14 of the body 12. An airlock 28 may be included to allow the contents of the container to be collapsed with a household vacuum cleaner. If the container 10 is partially filled with articles, leaving significant empty space, a vacuum cleaner may be connected to the airlock 28 to siphon air from with the container 10. As air is siphoned out, the accordion folds 18 of the sidewall 16 collapse, thereby shrinking the dimensions of the container 10, enabling the container 10 to be stored in small spaces.

The lid 26 also provides additional structural rigidity and support to the body 12 of the container 10. The lid 26 may include resilient locking members 30 to secure the lid 26 to the collar 22. Unlocking the locking members 30, unseals the container if it has been vacuum packed, permitting the sidewall 16 to expand back to full size.

Therefore, it can be seen that the present invention provides a unique solution to the problem of providing a collapsible container that take little room when not in use, yet may expand to a full size container useful to store items, such as clothing, blankets and other articles, when not in use.

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. A collapsible container, comprising:

a body having an open top end, a sidewall having an accordion fold formed from a plurality of fixed pleats in the sidewall, and a bottom panel enclosing a bottom end, the sidewall subdivided into four sides having four corners, the accordion fold in the sidewall permitting the sidewall to collapse and expand between a collapsed position and an expanded position, the bottom panel further having four spaced-apart cups thereon;

a collar formed at a top end of the body, extending from the sidewall and defining the open top end, the collar having four spaced-apart cups opposite the four space-apart cups on the bottom panel; and four tubular supports configured and arranged to prop the sidewall in a fully expanded position by supporting the collar away from the bottom panel, the four supports positioned in each of the four corners and each having an end that is received in the corresponding cup on the collar and the opposite end of the support on the cup on bottom panel, respectively, the four supports further removable from the collar and bottom panel to permit the body to collapse.

2. The collapsible container of claim 1, wherein two of the four sides has a generally rectangular shape.

3. The collapsible container of claim 1, wherein two of the four sides has a generally square shape.

4. The collapsible container of claim 1, wherein the body has a rectangular open top end.

5. The collapsible container of claim 1, further comprising a lid configured and arranged to enclose the open top end.

6. The collapsible container of claim 5, wherein the lid is configured and arranged to be snap-received over the collar.

7. The collapsible container of claim 5, wherein the lid further comprises an airlock therethrough, permitting the body to be vacuum sealed.

8. A collapsible container, comprising:

a body having an open top end, a continuous, sidewall having an accordion fold formed from a plurality of fixed pleats in the sidewall, the pleats running parallel to the open top end of the body, and a bottom panel enclosing a bottom end, the sidewall subdivided into four adjoining sides having four corners, the accordion fold in the sidewall permitting the sidewall to collapse and expand between a collapsed position and an expanded position, the bottom panel further including four space-apart cups;

a collar formed at a top end of the body, extending from the sidewall and defining the open top end, the collar having four spaced-apart cups opposite the four spaced-apart cups on the bottom panel;

four tubular supports configured and arranged to prop the sidewall in a fully expanded position by supporting the collar away from the bottom panel, the four supports positioned in each of the four corners, respectively, wherein an end of each support is received in a corresponding cup on the collar and an opposite end of each support received in a corresponding cup on the bottom panel, respectively, the supports further configured to be completely removable from the collar and bottom panel; and a lid configured and arranged to snap-receive to the collar in sealing engagement and lock thereto via a number of resilient locking members, enclosing the open top end, the lid including an airlock configured and arranged to attach to a vacuum cleaner, permitting the body to be vacuum sealed, thereby collapsing the sidewall.

9. The collapsible container of claim 8, wherein two of the four sides has a generally rectangular shape.

* * * * *